United States Patent [19]

Agee

[11] Patent Number: 4,791,683

[45] Date of Patent: Dec. 20, 1988

[54] HUNTER'S GLOVE

[76] Inventor: Jerry W. Agee, Rte. 1, Box 362, Paragould, Ark. 72450

[21] Appl. No.: 131,031

[22] Filed: Dec. 10, 1987

[51] Int. Cl.[4] ..... A41D 19/00

[52] U.S. Cl. ..... 2/161 A; 2/159

[58] Field of Search ..... 2/161 A, 161 R, 159, 2/158

[56] References Cited

U.S. PATENT DOCUMENTS

| | | | |
|---|---|---|---|
| 133,319 | 11/1872 | Kehoe . | |
| 1,849,418 | 3/1932 | Chesebro | 2/158 |
| 2,270,882 | 1/1942 | Link . | |
| 2,315,889 | 4/1943 | Wells | 2/158 |
| 3,299,441 | 1/1967 | Slimovitz . | |
| 3,372,401 | 3/1968 | Woodward . | |
| 4,195,365 | 4/1980 | Eyman et al. . | |
| 4,383,336 | 5/1983 | Beckman et al. | 2/158 |
| 4,654,895 | 4/1987 | Peters | 2/161 A |
| 4,691,388 | 9/1987 | Boone | 2/161 A |
| 4,704,743 | 11/1987 | Thornell et al. | 2/161 A X |

*Primary Examiner*—Werner H. Schroeder
*Assistant Examiner*—Jeanette E. Chapman
*Attorney, Agent, or Firm*—Norman B. Rainer

[57] ABSTRACT

A hunter's glove is provided which affords thermal protection of the hand yet enables a game calling device to be placed against the skin of the palm of the hand to facilitate production of a more realistic sound. Such functionality is achieved by a flap attached to the glove at a site opposite the thumb portion and adapted to removably occlude a matching aperture in the palm portion of the glove. The flap is held in place in its closed position above the aperture by Velcro attachment material.

4 Claims, 2 Drawing Sheets

HUNTER'S GLOVE

BACKGROUND OF THE INVENTION

This invention concerns a glove particularly adapted for use by a hunter using a device for producing sound that attracts the prey.

Animal calling devices are intended to produce noises that secure the attention of particular animal species. In order to be effective, the noise must be accurate in critical tonal characteristics. Many such calling devices produce the desired sound when blown into, and most are hand-held. Duck calling devices in particular are designed to be held in the palm of the hand while the hunter blows into the device to produce the proper sound.

In most duck-hunting situations, the weather is cold, and the hunter must wear thermally protective gloves. The present invention is based in part upon the observation that a duck calling device, if operated upon the gloved surface of the palm of the hand, produces a muffled sound lacking sufficient authenticity to be effective.

It is accordingly an object of the present invention to provide a glove for thermal protection of a human hand, said glove permitting effective use of an animal calling device.

It is another object of this invention to provide a glove as in the foregoing object particularly useful with a calling device intended to be held against the palm of the hand.

It is a further object of the present invention to provide a glove of the aforesaid nature which easily permits controlled exposure of the palm of the hand to a duck calling device.

It is a still further object of this invention to provide a glove of the aforesaid nature of rugged and durable construction amenable to low cost manufacture.

These objects and other objects and advantages of the invention will be apparent from the following description.

SUMMARY OF THE INVENTION

The above and other beneficial objects and advantages are accomplished in accordance with the present invention by a glove fabricated of compliant thermally insulative material comprising:

(1) a palm portion, a back portion, thumb and finger portions, (2) an aperture substantially centered within said palm portion, (3) a first border of hook and loop type attachment material disposed upon said palm portion and surrounding a substantial portion of said aperture, (4) a flap having a size and configuration to occlude said aperture and uniformly contact said first border, said flap being attached to the glove at a site opposite the thumb portion and having a lower surface adapted to face the hand and an upper surface directed away from the hand, said flap being foldable about its site of attachment to enable said upper surface to lie in contact with said back portion, (5) a second border of hook and loop type attachment material disposed upon the lower surface of said flap in a manner to interengage said first border, and (6) fastening means which enable said flap to be secured upon said back portion.

Suitable hook and loop type attachment material is commercially available under the trademark VELCRO from the Velcro Corporation of N.Y. Such hook and loop attachment or fastening material are paired interactive members, each comprising a compliant base sheet having an upraised pile of synthetic fibers. The fibers of one member are in the form of loops. The fibers of the other interactive member are cut loops, which constitute hooks. When the two members of the fastening system are pressed together in face-to-face relationship, there is substantial engagement of hook fibers with loop fibers. A considerable effort must be applied to separate the members unless they are peeled apart, in which event the members are easily separated.

In preferred embodiments, the glove is of fabric construction and the flap, also of fabric, is attached by sewing to the side of the glove remote from the thumb portion. The aperture preferably has a configuration which is elongated in the direction between the site of attachment and the thumb portion. A substantially rectangular configuration of the aperture may be employed wherein the flap is attached at one of the short sides, and the other three sides are surrounded by said first border of Velcro. The flap would have a corresponding size and shape such that its perimeter extends to embrace said first border.

The fastening means is preferably comprised of a small piece of Velcro material disposed upon the upper surface of the flap, and an interactive piece of VELCRO material disposed upon the back portion of the glove located to engage the flap in its folded position.

In use, when the hunter desires to use the calling device, the flap is folded rearwardly to its storage state, making the palm available to receive the calling device. The flap is subsequently restored to its forward position where it preserves the thermally insulative integrity of the glove.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
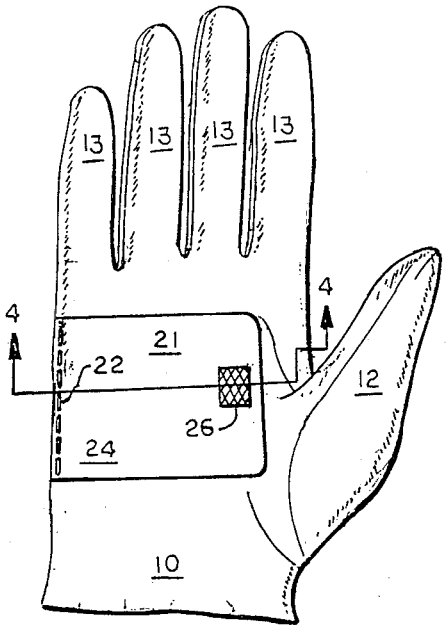
FIG. 1 is a plan view of the palm side of an embodiment of the glove of this invention, showing the glove in its closed state.

Referring to FIGS. 1–4, a right-handed embodiment of a glove of the present invention is shown comprised of palm portion 10, opposed back portion 11, thumb portion 12 and finger portions 13. The glove is preferably made of a thick, durable, tight weave fabric having thermally insulative characteristics. Typical fabrics may contain synthetic fibers such as nylon, polyester, and polyolefin. The fibers may have a hollow interior for increased thermal barrier properties. Natural fibers such as wool may be incorporated into the fabric. The fabric may have water-proof characteristics by virtue of specialized coatings or film-interlayers. The fabric may be of multi-layered or laminated construction but must be sufficiently compliant to preserve features of comfort, movement, and tactile sensitivity. The glove is preferably fabricated by cutting and sewing operations carried out upon suitable fabric material.

An aperture 14 of substantially rectangular configuration is centered within palm portion 10. The perimeter 15 of the aperture is provided with a sewn serving, or otherwise treated to prevent fabric unraveling. The perimeter of the exemplified embodiment has upper and lower long edges 16 and 17, respectively, and left and right short edges 18 and 19, respectively.

A first border 20 of VELCRO attachment material is disposed upon said palm portion in closely surrounding relationship with edges 16, 17 and 19 of aperture 14. The VELCRO material may be affixed by adhesives or sewing to said palm portion.

A flap 21 fabricated of material acceptable for fabrication of other portions of the glove is shaped to have a size and configuration capable of occluding aperture 14 and associated border 20. Flap 21 is attached to the glove by sewing at a site 22 which also constitutes left short edge 18. The flap may be further characterized as having a lower surface 23 adapted to face the head of the wearer of the glove, and an upper surface 24 directed away from the hand. The flap is foldable about its site of attachment 22, thereby enabling upper surface 24 to lie in contact with back portion 11.

Figure 4:
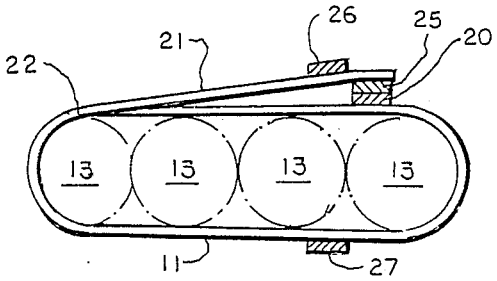
FIG. 4 is a sectional view taken along the line 4—4 of FIG. 1.
Figure 5:
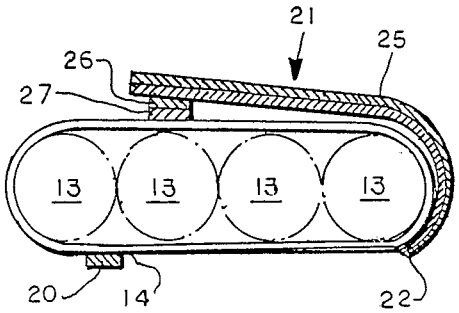
FIG. 5 is a sectional view taken along the line 5—5 of FIG. 3.

A second border 25 of VELCRO attachment material is disposed upon lower surface 23 in a manner to interengage first border 20 when the flap is in the closed state shown in FIGS. 1 and 4.

Figure 2:
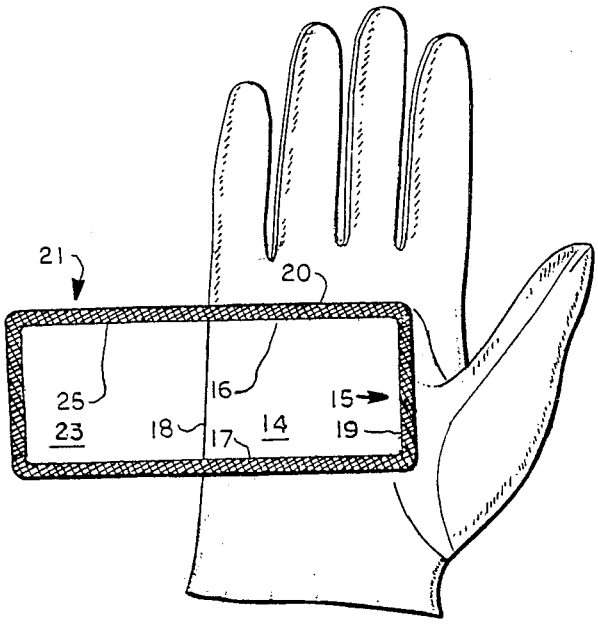
FIG. 2 is a plan view of the palm side of the glove of FIG. 1 with the flap opened but not yet secured to the back portion of the glove.
Figure 3:
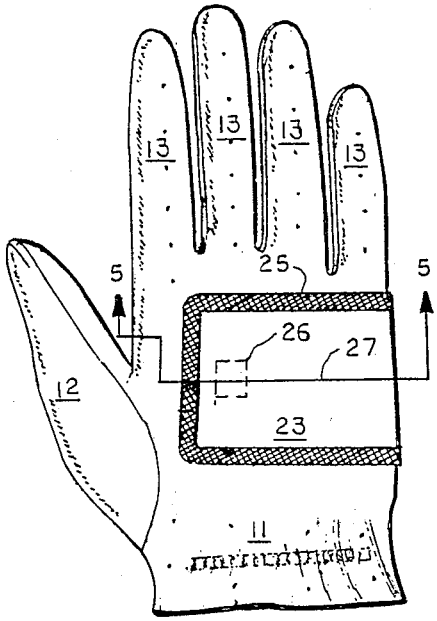
FIG. 3 is a plan view of the back portion of the glove of FIG. 1 in its open state with the flap secured to the back portion of the glove.

Fastening means in the form of mating pieces of VELCRO 26 and 27 attached, respectively, to upper surface 24 and back portion 11 enable the flap to be secured in the open state shown in FIGS. 2 and 4.

By virtue of its specialized manner of construction, the glove of this invention enables the hunter to position a duck calling device against the skin of the palm of his hand for maximum effectiveness, and enables the hunter to quickly close the glove for warmth.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A glove fabricated of compliant thermally insulative material comprising:

(1) a palm portion, a back portion, thumb and finger portions, (2) an aperture substantially centered within said palm portion, (3) a first border of hook and loop type attachment material disposed upon said palm portion and surrounding a substantial portion of said aperture, (4) a flap having a size and configuration to occlude said aperture and uniformly contact said first border, said flap being attached to the glove at a site opposite the thumb portion and having a lower surface adapted to face the palm portion, and an upper surface directed away from the palm portion, said flap being foldable about its site of attachment to enable said upper surface to lie in contact with said back portion, (5) a second border of hook and loop type attachment material disposed upon the lower surface of said flap in a manner to interengage said first border, and (6) fastening means which enable said flap to be secured upon said back portion.

2. The glove of claim 1 of fabric construction and wherein the flap, also of fabric, is attached by sewing to the side of the glove remote from the thumb portion.

3. The glove of claim 2 wherein said fastening means is comprised of a piece of hook and loop type attachment material disposed upon the upper surface of the flap, and an interactive piece of hook and loop type attachment material disposed upon the back portion of the glove and located to secure the flap in its rearwardly folded position.

4. The glove of claim 3 wherein said first border is contiguous to said aperture, and said second border is contiguous to the periphery of said flap.

* * * * *